United States Patent [19]

LePrevost, Jr.

[11] Patent Number: 4,792,129

[45] Date of Patent: Dec. 20, 1988

[54] RADIATOR FIXTURING DEVICE

[76] Inventor: Frederic H. LePrevost, Jr., 315 Myra Pl., Clinton, Iowa 52732

[21] Appl. No.: 164,975

[22] Filed: Mar. 7, 1988

[51] Int. Cl.[4] ..... B25B 1/00

[52] U.S. Cl. ..... 269/46; 269/71; 269/156; 269/237; 269/258

[58] Field of Search ..... 269/71, 237, 258, 156, 269/46, 152, 209; 29/157.3, 727

[56] References Cited

U.S. PATENT DOCUMENTS

| | | | |
|---|---|---|---|
| 1,344,559 | 6/1920 | Ohmacht . | |
| 1,497,107 | 6/1924 | Lasell | 269/156 |
| 2,602,990 | 8/1947 | Ferguson . | |
| 2,679,092 | 5/1954 | Austin | 269/71 |
| 3,429,567 | 2/1969 | Swan | 269/156 |
| 4,216,947 | 8/1980 | Chausse . | |
| 4,324,393 | 4/1982 | Chausse . | |
| 4,411,414 | 10/1983 | Desiro . | |

*Primary Examiner*—Robert C. Watson

*Attorney, Agent, or Firm*—Morton S. Adler

[57] ABSTRACT

This is an apparatus to facilitate securing radiator tanks onto header plates of automotive radiators and the like of a type made either from brass or of plastic having a gasket trough and integral header tabs. It includes opposed rails suspended from an overhead support, preferably circular to afford 360° rotation, and arranged for individual movement towards and away from each other in substantially parallel relationship to support the header on different thicknesses of radiators for mounting the tank thereon. In one position, opposed edges of the rails are notched to hold radiators of varying sizes and types with easy access to header tabs on plastic radiators and in an inverted position, the rails are provided with a flange to support the underside of the gasket trough on plastic tanks with good access to the tabs. Opposed parallel channeled beams supported above the rails are designed to slidably receive and release any selective number of manually operated acme threaded screw clamps with a balanced crank handle on top and an adjustable V-shaped radiator tank engaging clamping pad on the bottom. Each clamp tilts laterally away from the tank on either side into selective detent held positions to provide access to the tank. Each screw clamp is provided with pressure calibrated spring means and pressure indicating indicia to obtain uniform pressure on the tank. This apparatus permits use of conventional tab tools and weighs approximately fifty pounds so it can be conveniently stored when not in use or transported to any desired location.

25 Claims, 6 Drawing Sheets

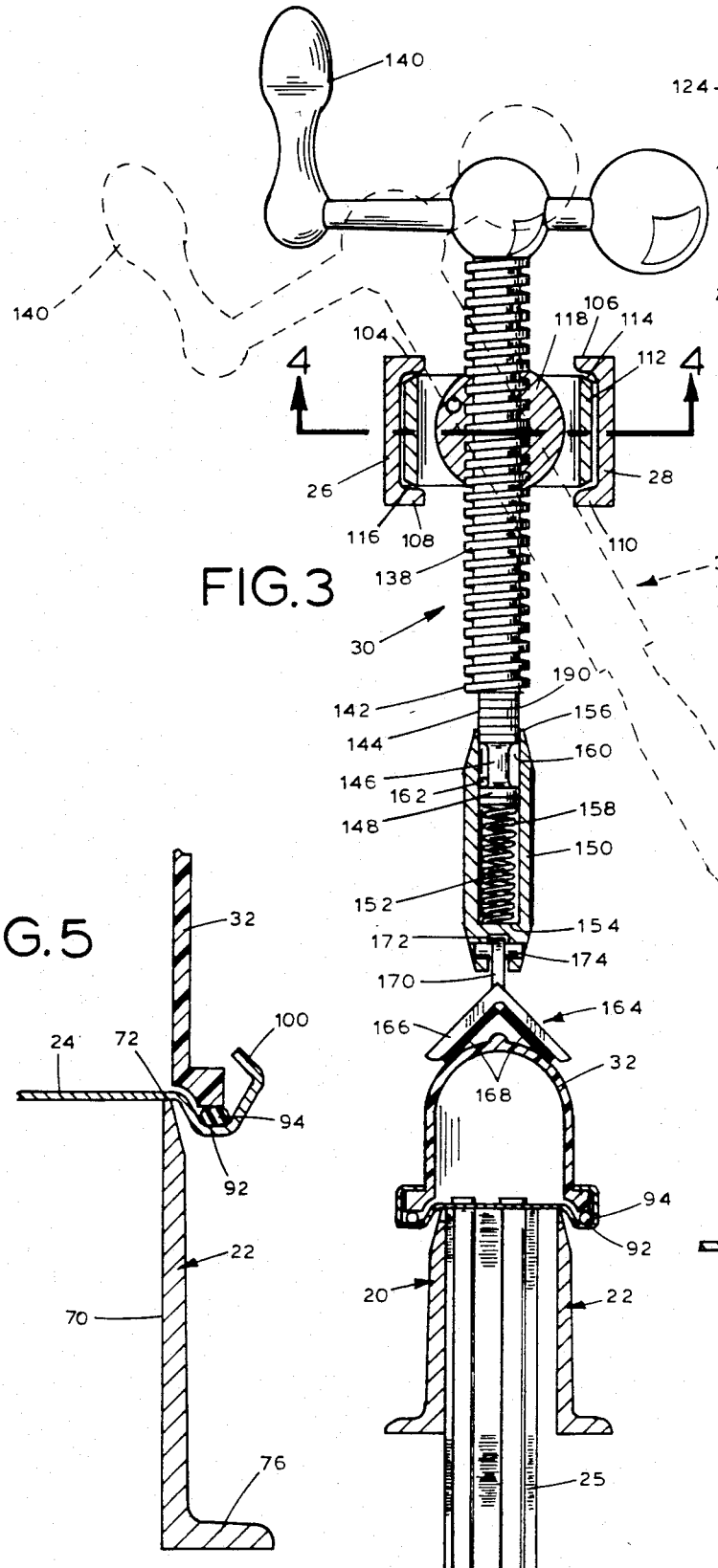
FIG. 3
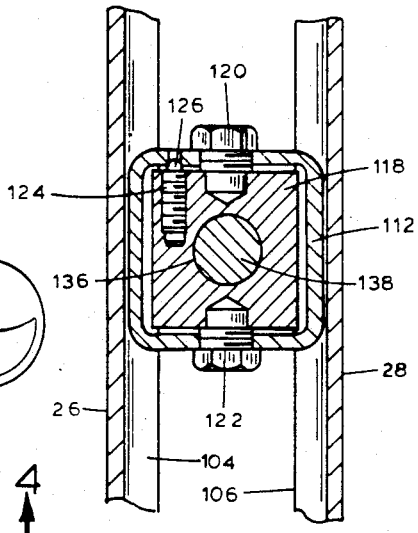
FIG. 4
FIG. 5
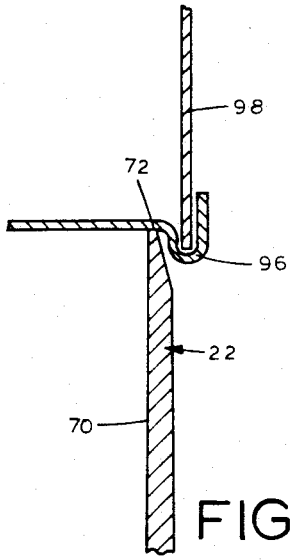
FIG. 7

FIG.8
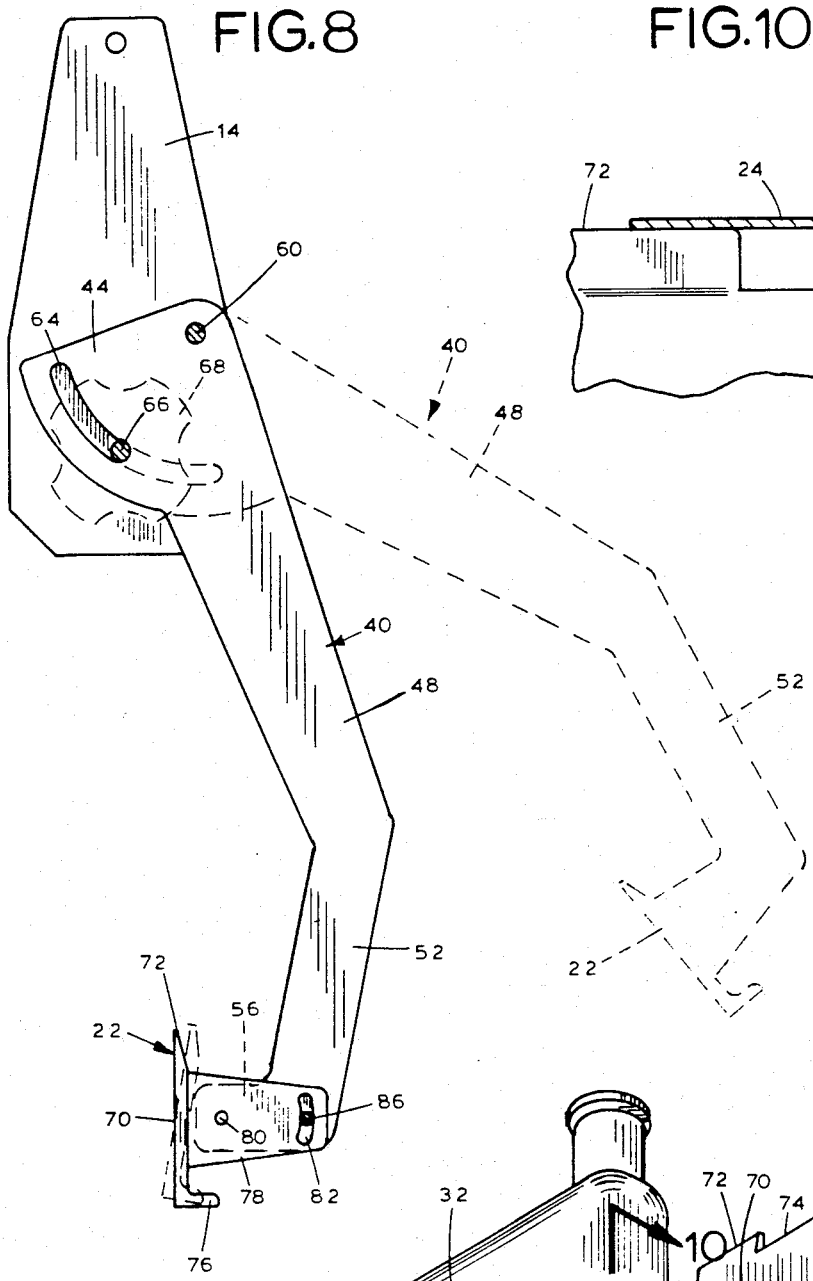
FIG.10
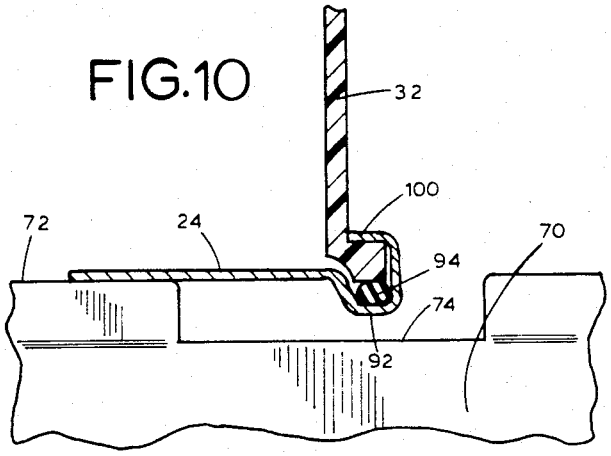
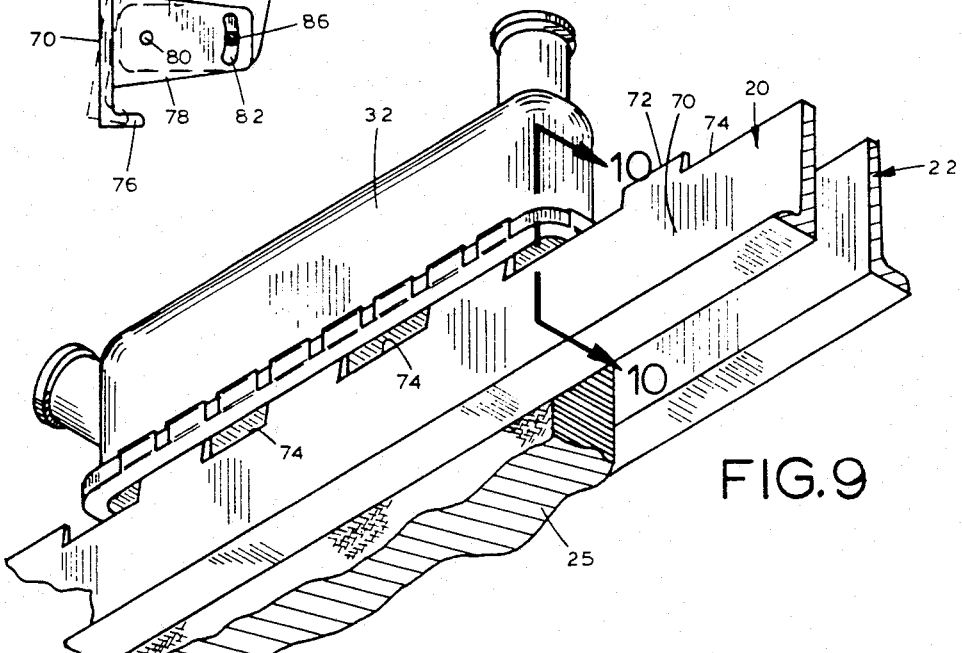
FIG.9

RADIATOR FIXTURING DEVICE

BACKGROUND OF THE INVENTION

This invention relates to the repairing of radiators and heaters of the type found in automobiles, trucks and other vehicles and more particularly to improvements in apparatus for fixturing or positioning such devices with means to facilitate remounting and securing the radiator tank to the radiator header after repairs are made.

Radiators date back to the early existence of the automobile and while both the materials and manufacturing techniques used have been greatly improved, the basic radiator construction, which has changed little since the first models, includes tubes, fins and headers which make up a cored housing for dissipating heat in a well known manner and tanks with fittings and brackets for attachment to each end of the core. When either the cored structure or tank must be repaired due to leakage, blockage or the like, the tank is generally removed and later replaced.

Traditionally, radiator construction has utilized a brass tank soldered to a brass header which requires remelting or melting out to remove the tank and re-soldering to replace the tank. The construction and maintenance of brass tanks is labor intensive and costly and mid 1970's saw the advent of the plastic tank by which injection moulding technology made possible the production of a radiator tank in a matter of minutes. This new process requires the use of expensive molds and due to the rapidly gaining acceptance and success of the plastic tank for radiator construction, it can be anticipated that the use of the plastic tank will continue to increase.

Attaching plastic tanks to the radiator headers requires a different joining process than when attaching metal tanks by soldering. For this purpose, the header is provided with a circumscribing channel or trough for receiving a gasket against which the tank is placed. Flat, oval or O-ring gaskets are used and these must be compressed by a uniform pressure for a fluid tight seal. The standard rule of thumb for compressing the gaskets properly is to compress them forty percent of their normal thickness and since different thicknesses and types of material are used in gaskets, it is generally difficult to determine the exact amount of force required. The important factor in this regard, however, is that the pressure applied is uniform across the width of the radiator in order to insure the best results.

Once the gasket is properly compressed, a variety of mechanical means are available on different radiators to secure the tank for maintaining the seal. Some Japanese and European radiator makers use separate crimping strips which lock under the gasket trough and over the lip of the tank. A Dutch company uses a process known as Nerfix which has strips that are pressed into header slots in a door latch fashion and another method includes the use of a dimpled header which has depressions that lock over the lip of the tank. The more popular fastening means, however, is the crimping tab which is in widespread use. This method utilizes serially arranged tabs integral with the header which are pressed up and over the lip of the plastic tank for a fluid seal engagement and which must be lifted up to release the seal and provide clearance for removal of the tank. I have observed that many fixturing machines now in use hold the radiator with parallel grooved bars that block access to all but the top part of the tab so that when the tab is lifted, all of the stress is placed at one radius point of the tab. It is thus not unusual for one or more of the tabs to break since on many radiators needing repairs the tabs have been in service for several years and have lost some of their original strength due to thermal expansion and contraction as well as prior bending and rebending and it is commonly known that if two or more tabs in a row break, the radiator cannot be easily repaired.

Many radiator repair and services devices used on brass tanks are not readily adaptable to the new plastic tanks and several new devices have been designed to address the problems posed by the plastic tanks. Most of these are large, heavy and costly and are not sufficiently versatile to efficiently and economically meet all of the requirements for making needed repairs. Some require the use of special tab tools and some include mechanical pressure elements such as air cylinders which in some instances have substantially damaged the tanks and headers due to excessive pressure or sudden or unexpected activation. In addition, some of these new devices require re-arrangement or replacement of parts to adapt to either brass or plastic tanks and, in general, have not satisfied the requirement of the small repair shop for a simple, convenient and efficient radiator repair apparatus.

With the foregoing observations in mind, it is one of the objects of this invention to provide an apparatus for fixturing or positioning the header of a repaired radiator with improved, efficient and economical means for remounting and securing the radiator tank to the header.

Another object is to provide an apparatus of the above class that can be used with equal efficiency on either brass or plastic radiator tanks.

A further object is to provide an apparatus as characterized that includes manually operated screw clamp assemblies for applying pressure to the top of the tank against the header.

Still another object is to provide said screw clamp assemblies with adjustable tank engaging pads and with the capability of moving transversely of the tank into selective detent locked positions to afford easy access to the tank in mounting it to said apparatus.

Another object is to provide an apparatus as characterized with the capability to receive and release a selective number of screw clamp assemblies according to the number required.

Yet another object is to provide each screw clamp assembly with an integral pressure calibrated spring means and pressure indicating indicia to provide uniform pressure on the tank throughout its length.

Another object to to provide an apparatus of the above class that is adjustable to accommodate various widths of radiators.

Still another object is to provide a radiator fixturing device which will support a tab type header for a plastic radiator tank to afford full and easy access to the tabs so they can be lifted or crimped with a minimum of stress and where the stress in lifting is distributed throughout the tab.

A further object is to provide an apparatus as described that is designed to be suspended from an overhead support and thus require no floor space and is preferably suspended from a circular support to afford 360° rotation of the radiator from a fixed position of the operator.

Another object is to provide an apparatus of the above class that is sufficiently light in weight to be easily stored or transported.

A further object is to provide a radiator fixturing device as characterized that permits the use of any available conventional tab tool.

SUMMARY

In accordance with the present invention, a radiator fixturing device is provided for securing radiator tanks onto header plates of automotive radiators and the like of a type made either from brass or of plastic having a gasket trough and integral header tabs. It includes opposed rails suspended from an overhead support, preferably circular with trolley means to afford 360° rotation, and arranged for individual movement towards and away from each other in substantially parallel relationship to support the header on different thicknesses of radiators for mounting the tank thereon. In one position, opposed edges of the rails are notched to hold radiators of varying sizes and types with easy access to header tabs on plastic radiators and in an inverted position, the rails are provided with a flange to support the underside of the gasket trough with good access to the tabs. Opposed parallel channel beams supported above the rails are designed to slidably receive and release any selective number of manually operated acme threaded screw clamps with a balanced crank handle on top and an adjustable V-shaped radiator tank engaging clamping pad on the bottom. Each clamp tilts laterally away from the tank on either side into selective detent held positions to provide access to the tank. Each screw clamp is provided with pressure calibrated spring means and pressure indicating indicia to obtain uniform pressure on the tank. This device permits use of conventional tab tools and weighs approximately fifty pounds so it can be conveniently stored when not in use or transported to any desired location.

The foregoing objects and such further objects as may appear herein, or be hereinafter pointed out, together with the advantages of this invention will be more fully discussed and developed in the more detailed description of the accompanying drawings.

BRIEF DESCRIPTION OF THE DRAWINGS

FIG. 3 is an elevational view, partially in section, showing a radiator with a plastic tank being supported and engaged by one of the screw clamp assemblies with an adjusted position of the screw clamp assembly shown in broken lines, FIG. 4 is a cross sectional view taken on the line 4—4 of FIG. 3, FIG. 5 is an enlarged fragmentary elevational view showing the support point for the header as seen at the bottom of FIG. 3 and showing a header tab in a loosened position, FIG. 7 is an enlarged fragmentary elevational view showing the support point for the header on a brass radiator tank, FIG. 8 is an enlarged elevational view of one of the arms on the arm assembly showing its adjustable position in broken lines and showing the adjustable position of the rail at the bottom with a notched surface for supporting a radiator, FIG. 9 is an enlarged fragmentary perspective view from the bottom of this device showing a radiator supported on notched rails, FIG. 10 is a view, partially in section, taken from the line 10—10 of FIG. 9.

DESCRIPTION OF THE PREFERRED EMBODIMENTS

Figure 1:
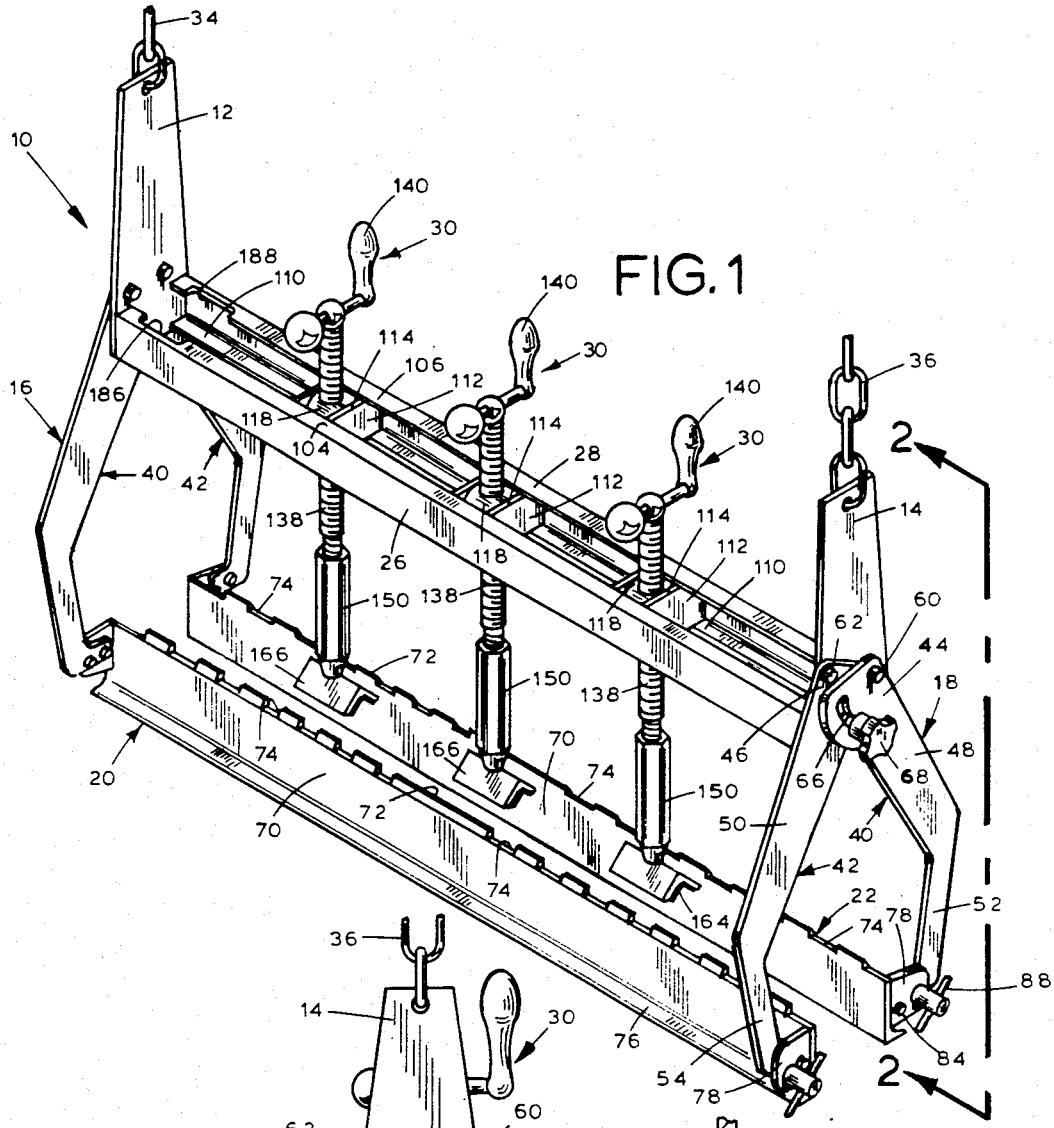
FIG. 1 is a perspective view of a radiator fixturing device according to this invention.
Figure 17:
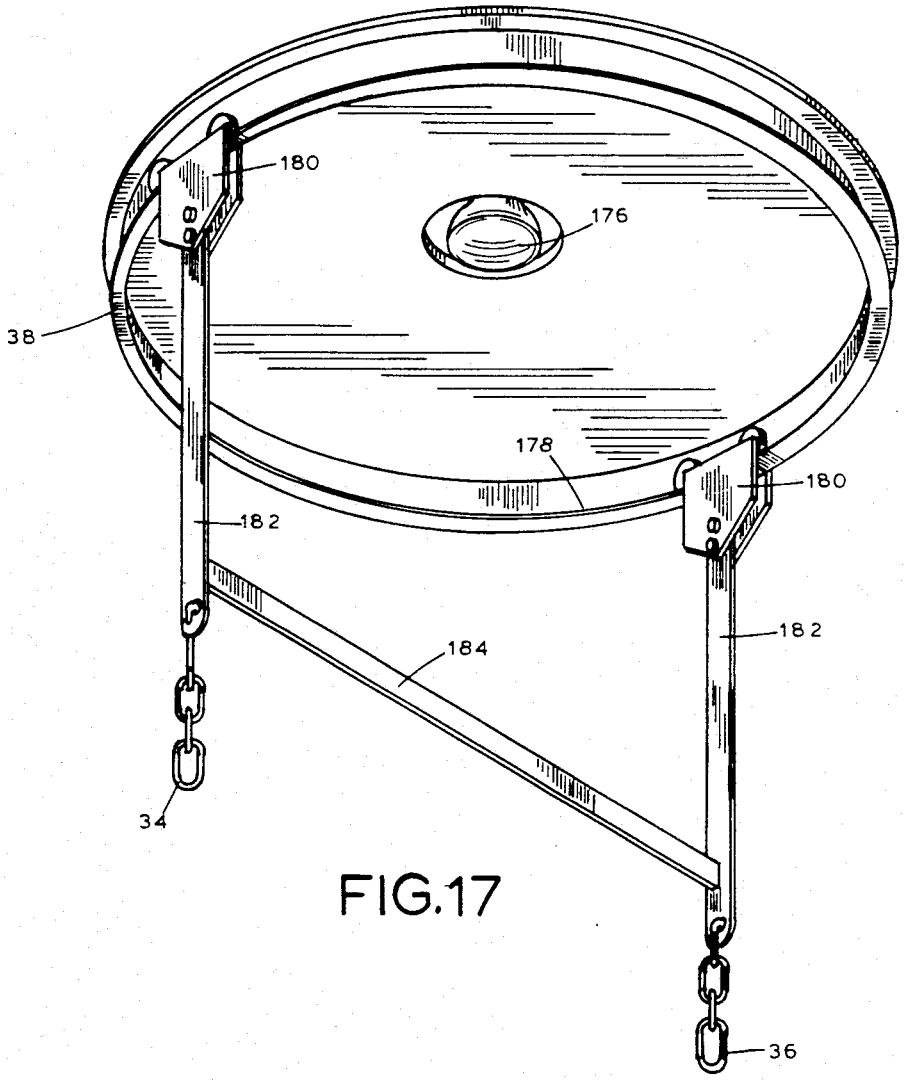
FIG. 17 is a perspective view of a preferred overhead support ring with center light for the device shown in FIG. 1

Referring to the drawings, this new radiator fixturing device is designated by the numeral 10 as best seen in FIG. 1 and includes generally a pair of vertically disposed spaced support plates 12, 14 for supporting respective arm assemblies 16, 18 that carry respective opposed parallel rails 20, 22 for supporting the header 24 on a radiator 25 as seen in FIG. 5. Plates 12, 14 also support opposed parallel channel beams 26, 28 above rails 20, 22 in which is mounted one or more manually operated screw clamp assemblies 30 for applying pressure to a radiator tank 32 against the header 24. Device 10 is adapted to be suspended from any suitable overhead support by chains 34, 36 so as not to occupy floor space and preferably to an overhead support ring 38 as seen in FIG. 17 for all of which a more detail description is as follows.

Figure 2:
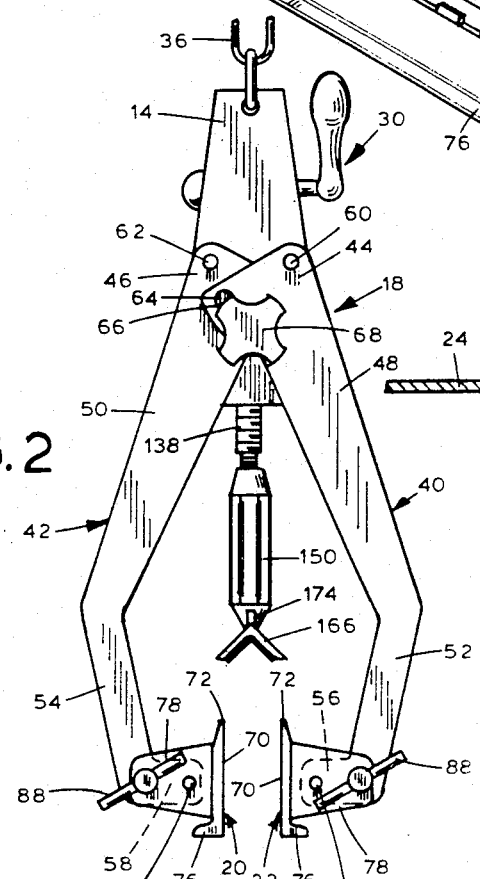
FIG. 2 is an end elevational view taken from the line 2—2 of FIG. 1.

With reference more particularly to FIGS. 1, 2, 8, the the arm assemblies 16, 18 depending respectively from support plates 12, 14 are of like construction and operation so that only assembly 18 will be described and like numerals given to like parts on assembly 16.

Assembly 18 comprises a pair of opposed arms 40, 42, preferably of bar material, and presenting a general bow configuration defined by respective top ends 44, 46 from which said arms extend first outwardly to form a respective upper arm portion 48, 50 and then downwardly and slightly inwardly to form the respective lower arm portions 52, 54 that terminate in the inwardly extending respective ears 56, 58. The top ends 44, 46 are in part disposed in juxtaposition with each end separately pivotally secured to plate 14 by pins 60, 62 whereby arms 40, 42 can be moved separately or simultaneously towards and away from each other. The juxtaposed portions of said top ends 44,46 are provided with registering arcuate slots 64 through which there extends a threaded shaft 66 secured to plate 14 and on the outer end of which is a single manually rotatable knob 68 for locking both arms 40, 42 in any position of adjustment relative to each other.

Figure 12:
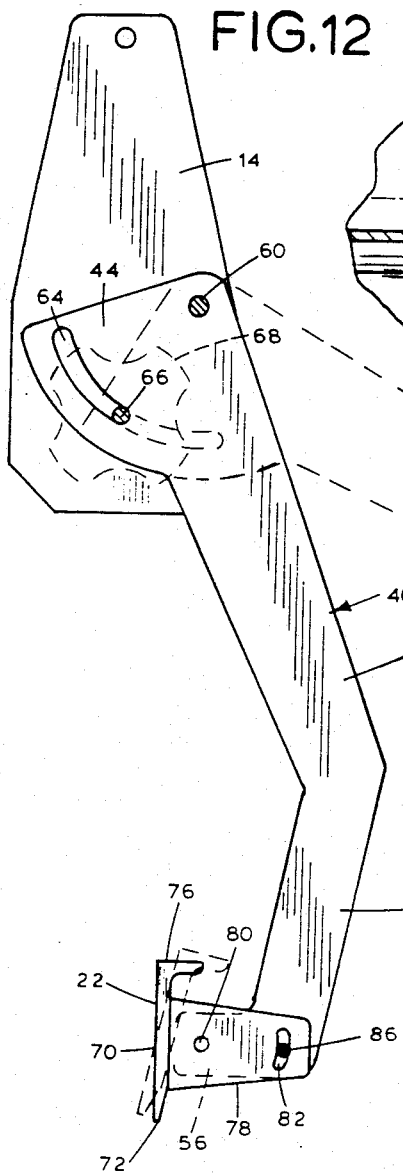
FIG. 12 is a view similar to FIG. 8 but showing the bottom rail in an inverted position to present a flange support for the radiator.

Rails 20, 22 which are carried by the lower ends of arm assemblies 16, 18 are of like construction so only one will be described in detail and like numerals given to like parts on the other. Each rail 20, 22 is elongated defining an upstanding face 70 having a top edge 72 provided with a plurality of spaced notches 74 and a bottom edge defined by an outwardly extending lip or flange 76. An outwardly extending ear 78 (FIGS. 1,2) secured to each end of each rail 20, 22 intermediate edges 72, 76 is provided with a hole 80 near its inner end and an arcuate slot 82 near the outer end thereof. Rails 20, 22 are disposed with faces 70 opposed and parallel intermediate the lower ends of arm assemblies 16, 18 and a respective ear 78 is placed in juxtaposition with a corresponding ear 56, 58 on the arm assemblies so that hole 80 and slot 82 in ears 78 register with respective threaded holes in ears 56, 58 (not shown). A stud bolt 84 (FIG. 1) removably secures abutting ears through hole 80 and a second stud bolt 86 (FIGS. 8,12) with a handle 88 is secured through slot 82 into the abutting arm assembly ear as seen in FIGS. 1,2. By this arrangement, handle 88 is provided to loosen bolt 86 so that faces 70 on rails 20, 22 can be adjusted on slot 82 to parallel relationship in different spacing relationship of rails 20, 22 as may be required on different thicknesses of radiators 25 (FIG. 3).

Thus far described, it will be understood that device 10 is used to support a radiator 25 so that rails 20, 22 engage the underside of the header 24 inwardly of the trough 92 in which there will be a gasket 94 for a plastic tank 32 as seen in FIGS. 3,5 or inwardly of the trough 96 in which a brass tank represented at 98 is soldered as seen in FIG. 7. By this arrangement and particularly with regard to plastic tanks, it will be apparent that the header tab 100 is freely and fully accessible for any conventional crimping tool illustrated at 102 in FIG. 6. Rails 20, 22 are adjustable to accommodate different thicknesses of radiators which for all practical purposes will be in the range of one to six inches and for this purposes, arms 40, 42 of each arm assembly can be easily locked in any position by the single knob 68. Knob 68, it will be noted, is located and operates at the top of the arm assemblies and since the bottom end of said arm assemblies 16, 18 do not have and do not require any transverse connecting means as is present on other devices of this type, there is full and easy access to the ends of the radiator to permit the use of any conventional hand crimping tool. Faces 70 of rails 20, 22 are adjustable to parallel relationship as arm assemblies 16, 18 are adjusted to radiator widths as previously described.

Figure 6:
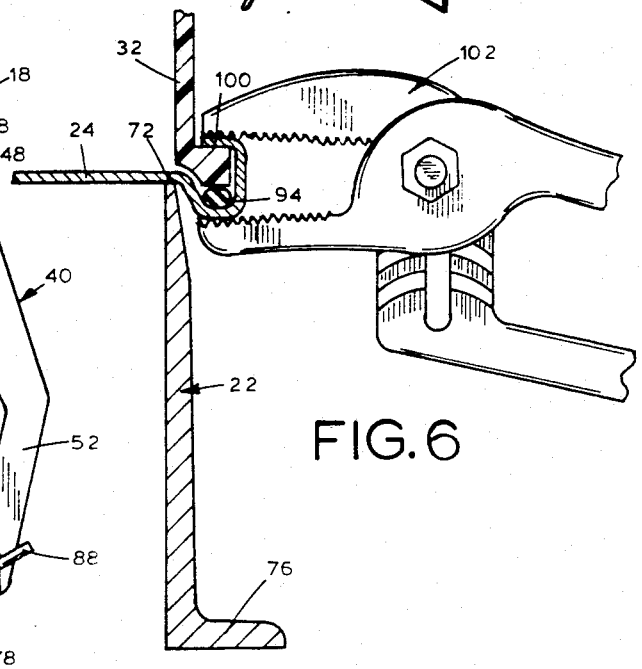
FIG. 6 is a view similar to FIG. 5 showing the accessibility of the tabs for a conventional type tool for engaging and crimping the tab.
Figure 15:
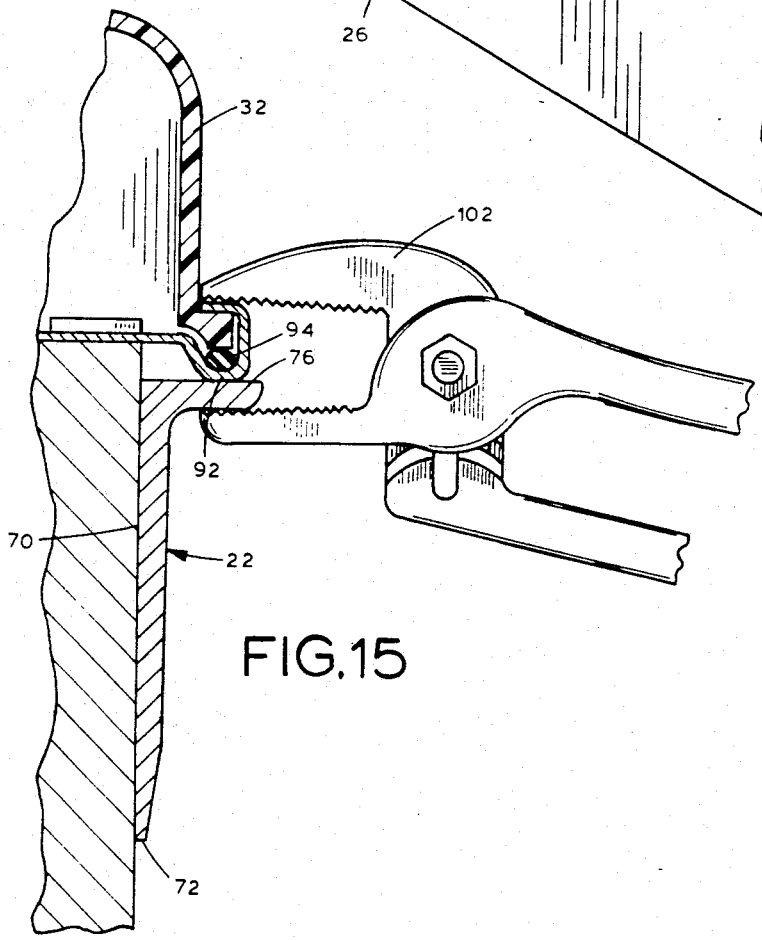
FIG. 15 is a view similar to FIG. 6 showing the clamping of a header tab when the radiator is supported on the flanged portion of the support rails.
Figure 16:
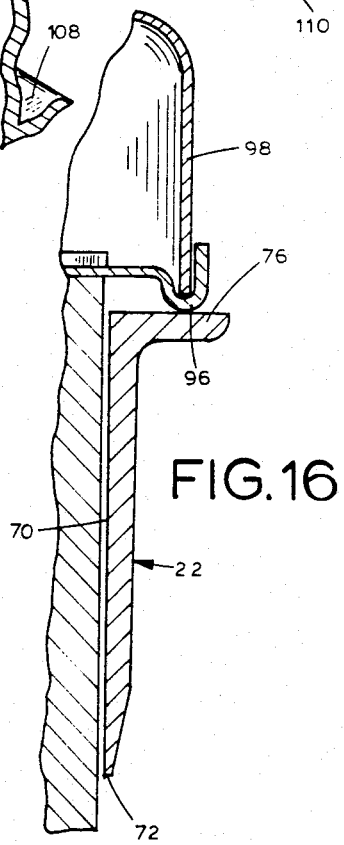
FIG. 16 is an enlarged fragmentary view, partially in section, showing a brass radiator supported by the flanged portion of the support rails.
Figure 14:
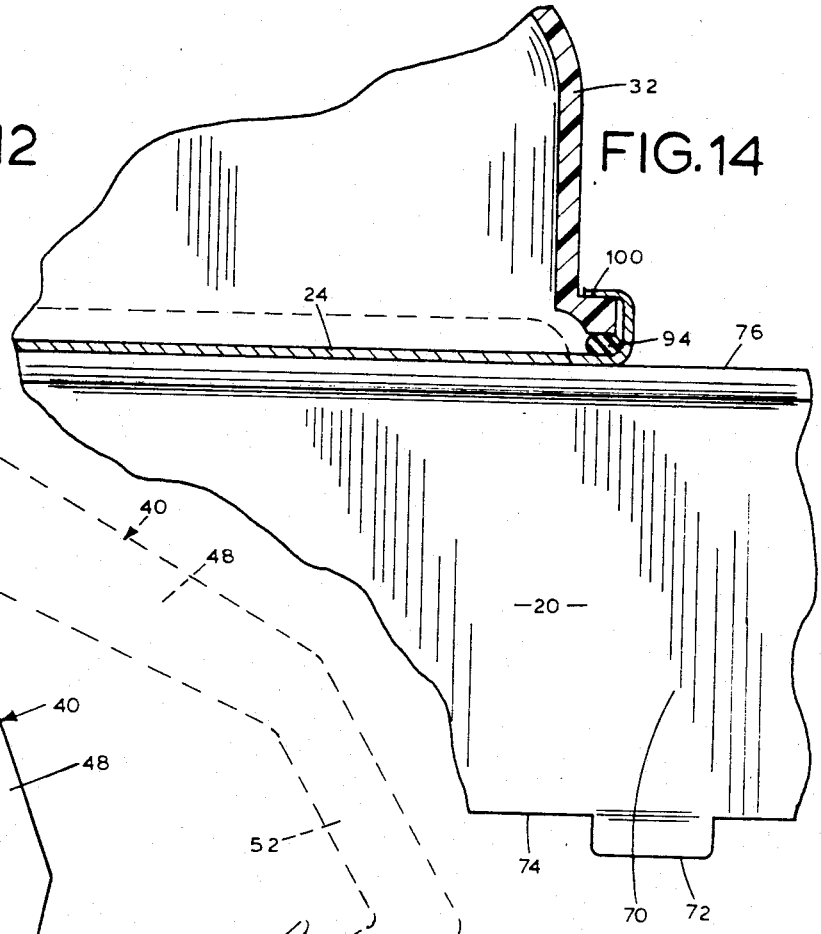
FIG. 14 is a view, partially in section, taken from the line 14—14 of FIG. 13.
Figure 13:
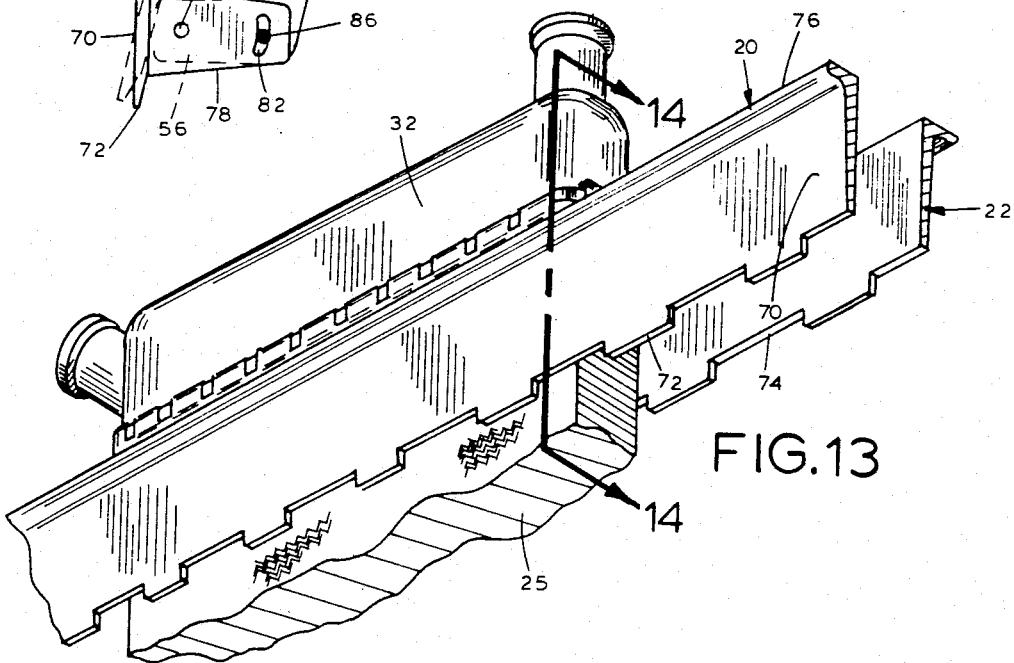
FIG. 13 is a view similar to FIG. 9 but showing the radiator supported on the flanged edge of the support rails

Rails 20, 22 may be mounted to arm assemblies 16, 18 and adjusted thereon as described to support a radiator 25 either with their top edges 72 with notches 74 as the supporting surface as seen in FIGS. 1,9,10 or with the flange end 76 as the supporting surface as seen in FIGS. 13,14. When the notched surface is used not only are the tabs 100 fully exposed for access as seen in FIG. 6 but particularly the ends of the radiator which are disposed in a notched area as seen in FIG. 10 are fully exposed and accessible in a manner not presently available on other radiator fixturing devices. By this arrangement, device 10 while primarily designed for remounting the tank on a repaired radiator can also be conveniently used, if desired, to support the radiator for removal of the tank and because tabs 100 are fully accessible, they can be lifted in a way to distribute the stress more evenly rather than concentrate it at one point as occurs in other devices and thus reduce the incidence of tab breakage. When the flange 76 is used to support a plastic tank (FIG. 15) or a brass tank (FIG. 16), it provides a bearing surface for tool 102 and if the notched edge 72 is used to support a brass tank (FIG. 7), the outer edge of the header is freely accessible to be tapped by a hammer or the like to move it closer to the tank for better soldering.

Figure 11:
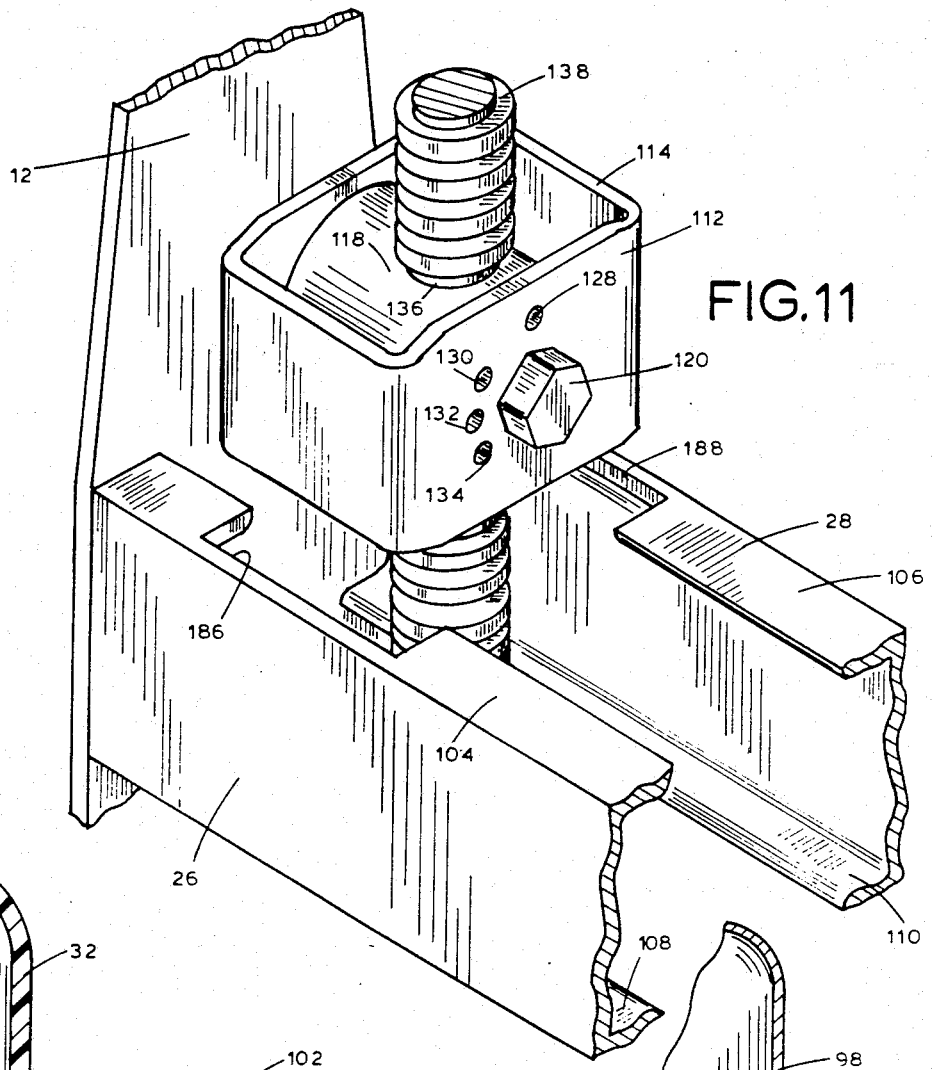
FIG. 11 is an enlarged fragmentary view of the screw clamp assembly shown being mounted into the channel beams of this device.

Referring now more particularly to FIGS. 1, 3, 11, the opposed spaced parallel channel beams 26, 28 are suitably secured to and intermediate plates 12, 14 in a position above and parallel to rails 20, 22 (FIG. 1). Such beams provide the respective opposed upper lips 104, 106 and the respective opposed lower lips 108, 110 that serve as a trackway and support for one or more of my new and improved screw clamp assembly 30 as will appear.

Assembly 30 includes a substantially square or block shaped hollow housing 112 adapted as will later be described in more detail to be slidably disposed within the trackway of beams 26, 28 (FIG. 1) and for which purpose to facilitate movement therein, the top and bottom edges are preferably beveled as at 114, 116 (FIG. 3). A solid cylindrical member 118, preferably of brass, is disposed within housing 112 (FIGS. 3,4, 11) and mounted thereto by opposed pilot screws 120, 122 so that it is capable of being rotated transversely of the longitudinal axes of beams 26, 28. A screw plunger 124 is mounted in cylinder 118 so that the detent end 126 abuts an inner side of housing 112 to seat in any one of the housing detent holes 128, 130, 132, 134 (FIG. 11) as will later be referred to in more detail.

Cylinder 118 is provided with a through threaded bore 136 to receive an elongated acme screw 138 designed for manual rotation by means of a balancedcrank handle 140 on the top end (FIG. 3). The threads on screw 138 terminate near the lower end as at 142 from which there extends a reduced unthreaded shank 144 and from which there is the further reduced shank 146 that terminates in the plate or plunger head 148 having the same diameter as shank 144. An elongated housing 150, preferably with a hex shaped exterior as shown, is provided with an elongated recess or chamber 152 that is closed at the bottom to define a seat 154 and communicates with the top end 156 so that such top end 156 can embrace shanks 144, 146 and plunger head 148. A compression spring 158 with a predetermined pressure rating is disposed in chamber 152 with one end on seat 154 and the opposite end abutting head 148 as seen in FIG. 3. The reduced diameter of shank 146 provides the chamber 160 into which a roll pin 162 is mounted through housing 150 so that said housing is rotatable relative to screw 138.

A radiator engaging pad 164 carried at the bottom end of housing 150 is of an inverted V shape 166 with attached rubber padding 168 for engaging a tank and an integral apertured stem 170 projecting from the apex of the V as seen in FIG. 3. Stem 170 is journalled in a confining well 172 at the bottom of housing 150 and attached thereto by the roll pin 174 whereby pad 164 can be rotated with housing 150. The free end of stem 170 is slightly spaced from the closed end of well 172 so that as viewed in FIG. 3, stem 170, due to the confining relationship of the walls of well 172, cannot be pivoted or tilted to the left or right but can, to a limited degree, be tilted towards and away from the viewer and this limiting of the tilt in only two opposite directions facilitates the correct positioning of pad 164 on a curved or slanted radiator surface.

While device 10 may be suspended from any suitable overhead support by means of chains 34, 36, a preferred form of such support is the overhead mounted ring 38 with an axially positioned light 176 suitably wired and switched (not shown) in any well known manner as seen in FIG. 17. Ring 38 defines the circular track 178 on which is mounted a pair of like trollies 180 that each have depending bars 182 held in spaced relationship by the crossbar 184 so that chains 34, 36 can be conveniently secured to the lower ends of bars 182 as shown. By this arrangement, a worker servicing a radiator supported on device 10 can rotate device 10 and the radiator 360° from one position for quick and easy access to any part of the radiator.

It will be understood that the size of device 10 may be varied for use with large and heavy radiators but as a practical and economical fixturing device for the ordinary repair shop, I have preferably made device 10 with rails 20,22 approximately thirty eight inches long that will accommodate all known plastic radiator tanks and generally all other radiators up to forty inches in width. I preferably use three screw clamp assemblies 30 (FIG. 1) and one of the improved and novel features of this invention is the fact that more or less than three assemblies 30 can be used as the situation may require as follows.

Housing 112 of each assembly 30 is slidably disposed in the trackway of beams 26, 28 so as to ride on lips 108, 110 and abut the underside of lips 104, 106 with screws 138 and pads 164 oriented towards rails 20, 22 as seen in FIG. 1. Opposed sections of lips 104, 106 are notched 186, 188 towards one end of the beams 26, 28 to provide an opening sufficient for the insertion or removal of housing 112 as seen in FIGS. 1, 11 whereby any selected number of assemblies 30 can be placed in the trackway or removed therefrom as desired or required.

OPERATION

Radiator 32 is supported on rails 20, 22 by either the flanged edge 76 (FIGS. 13–16) or the notched edge 72 (FIGS. 3, 5–7, 9,10). Notches 74 divide the actual support surface 72 into a plurality of spaced planar sections which support the radiator header from a position just inside of the header trough to center the tank directly under the screw 138. The ends of the radiator are disposed in a notched area free of contact with any portion thereof (FIG. 10) where they are completely accessible for the use of a crimping tool. This is not only an advantage absent in other devices but with notched portions at the ends of the rails, a wide range of radiator sizes can be accommodated with one pair of rails.

In positioning a radiator on rails 20, 22, the space above the rails must be unobstructed for obvious reasons and while other fixturing devices using fixed overhead clamps must elevate them to their highest point of travel for necessary clearance, with device 10, pads 164 need be elevated only sufficiently to clear the top of the rails 20,22 since they can be rotated or tilted away from the rails (FIG. 3) to eliminate interferring with placing the radiator. In such rotation, detent positions 130, 132, 134 on housing 112 will hold assembly 30 at selected angles of approximately 150 to 210 degrees from the vertical for fast loading and unloading of the radiator and detent 128 will hold assembly 30 at the vertical once the radiator is mounted for servicing. It will generally be necessary to move only one of the rails by loosening knob 68, arranging the header on the other rail and moving the first rail into engagement with the header. Tightening of the single knob 68 will tighten both rails. The faces 70 of the rails can be adjusted to parallel for properly engaging the radiator if necessary as previously described.

With plastic tanks, the tank is positioned on gasket 94 so it can be pressed against the same into a fluid seal engagement and the tabs 100 crimped to maintain the seal. It is important that the pressure against the gasket be uniform at all points. With the radiator in place and assembly 30 locked in its vertical position, pad 166 is engaged with the radiator. For this purpose, housing 150 can be held with one hand of the operator to facilitate adjusting the pad while turning handle 140 with the other. In adjusting pad 166, the correct positioning on curved or slanted tanks without slipping is easily accomplished because such pad as described is rotatable but tiltable in only two opposite directions.

In spacing assemblies 30 relative to the tank, it is generally accepted that to provide proper clamping pressure across the full length of the tank the pads 166 should be placed approximately six to eight inches apart so that uniform pressure can be applied. Pressure is applied by manually turning the several handles 140 to move the plunger head 148 against spring 158. As this occurs, shank 144 will descend into housing 150 and for a visible measurement of the pressure being generated, I have provided pressure indicating indicia 190 on shank 144 as seen in FIG. 3 where such pressure reading is indicated by the position of the top end 156 of housing 150 relative to shank 144. By this arrangement, it is a simple matter for the operator to provide uniform pressure from each assembly 30 across the length of the radiator tank. It will be understood that indicia 190 may be in any suitable form or style for the intended purpose as for example, numerical designations, color coding to identify safe and dangerous limits and the like. To remove the radiator, only two or three turns of handle 140 is necessary to release pad 166 sufficiently for assembly 30 to be tilted out of the way. For brass tanks to be soldered, the radiator is mounted and assemblies 30 used as described and, as also refered to above, railes 20, 22 can be inverted to use flange 76 as the supporting surface if desired. Accordingly, in view of the foregoing, it is thought a full understand of the construction and operation of the invention will be had and the advantages of the same will be appreciated.

I claim:

1. A fixturing appratus for mounting a radiator tank to a radiator header for radiators including either brass tanks requiring soldering ot plastic tanks secured by crimped integral header tabs against a gasket in a peripheral header through, said apparatus comprising:

a pair of like opposed spaced arm assemblies each including individual arms forming a general bow configuration with respective top and bottom ends and adapted to be suspended from any suitable overhead support, respective means on said arm assemblies for effecting movement of said bottom ends towards and away from each other, respective means on said arm assemblies for locking said arms in any selected position of movement, a pair of opposed parallel rails defining radiator supporting surfaces carried by said bottom ends, opposed parallel channel beams operably disposed above and parallel to said rails, a manually operated screw clamp assembly removably slidably disposed intermediate said beams and including a crank handle and a radiator tank engaging pad, and pressure measuring means with pressure indicating indicia on said screw clamp assembly.

2. Apparatus as defined in claim 1 including means to suspend it from any suitable overhead support so as to not occupy floor space.

3. Apparatus as defined in claim 2 wherein said overhead support is a ring and said apparatu is movably arranged thereon so it can be rotated three hundred sixty degrees by an operator from a fixed position.

4. Apparatus as defined in claim 3 including:

said ring defining a circular track, a pair of trollies movably mounted on said track, and means operably suspending said apparatus from said trollies.

5. Apparatus as defined in claim 1 including said rails having longitudinally spaced corresponding notched areas defining spaced planar radiator supporting surfaces intermediate said notched areas whereby the radiator ends repose in a notched area free of rail contact to fully expose the tabs on said ends and make them completely accessible for bending and rebending by any conventional tool.

6. Apparatus as defined in claim 1 including:

means on said clamp assembly for tilting the same laterally away from said tank, and detent means on said clamp assembly to hold it in selective positions of tilting.

7. Apparatus as defined in claim 1 including means on said beams for the reception and removal of any selected number of screw clamp assemblies.

8. Apparatus as defined in claim 1 whe ein the respective means for effecting movement of the bottom ends of said arm assemblies and for locking said arm assemblies in selected positions of adjustment are on the top end of said arm assemblies to leave said bottom ends unobstructed from the ends for easy access to a radiator.

9. Apparatus as defined in claim 1 including:

means rotatably mounting said radiator tank engaging pads to said screw clamp assembly, and means positioning said radiator tank engaging pad so that it is tiltable in only two opposite directions.

10. Apparatus as defined in claim 1 including said rails being pivotally mounted to said bottom ends of said arm assemblies so that they can be maintained in parallel relationship in any position of movement of said arms.

11. Apparatus as defined in claim 1 including said rails being provided with a radiator upporting surface in the form of an outwardly extending flange for engagement with the underside of the trough to provide a bearing point for a tab tool.

12. A fixturing apparatus for mounting a radiator tank to a radiator header for radiators including either brass tanks requiring soldering or plastic tanks secured by crimped integral header tabs against a gasket in a peripheral header trough, said apparatus comprising:

a pair of spaced vertically disposed support plates adapted to be removably secured to and suspended from any suitable overhead support, a depending arm assembly on each of said plates, each arm assembly including opposed individual arms forming a general bow configuration with respective top and bottom ends, the top ends of respective arms being in juxtaposition and individually pivotally secured to a respective plate so that said bottom ends can be selectively moved towards and away from each other, respective means engageable with said top ends to lock said arms in any selective position of adjustment relative to each other, a pair of elongated opposed parallel rails carried by said bottom ends defining support surfaces for headers of varying widths, opposed parallel channel beams secured to and between said plates above and parallel to said rails, a manually operated screw clamp assembly including an elongated screw with a crank handle on top and a radiator tank engaging pad on the bottom, and means on said beams to receive said screw clamp assembly for slidable movement thereon and to permit the addition and substraction of selected numbers of said screw clamp assemblies.

13. Apparatus as defined in claim 12 including said rails being pivotally secured at each end to the bottom end of corresponding arms so they can be maintained parallel in spacing adjustments of said arm assemblies.

14. Apparatus as defined in claim 12 including:

a hollow block housing, said screw operably mounted in said housing to permit its tilting laterally relative to said rails, means on said housing to hold said screw in any selected position of tilt, and said channel beams provided with opposed notches near one end for insertion of said housing for slidable movement relative to said beams and to permit the addition and substraction of any selected number of said housings.

15. Apparatus as defined in claim 12 including:

a second elongated housing rotatable mounted to and depending from the bottom of said screw, a pressure calibrated spring mounted within said second housing and engageable by said screw, and visible pressure indicating indicia on said screw.

16. Apparatus as defined in claim 15 including:

said radiator tank engaging pad being of inverted V-shaped, the bottom of said second housing provided with a recess, and an integral stem projecting from the apex of said V operably engaged in said recess whereby said pad is rotatable with said second housing and tiltable in only two opposite directions relative to said recess.

17. Apparatus as defined in claim 12 including:

an overhead support ring defining a circular track, a pair of trollies movably mounted on said track, and means operably suspending said apparatus from said trollies.

18. Apparatus as defined in claim 12 including said rails having longitudinally spaced corresponding notched areas defining spaced planar radiator supporting surfaces intermediate said notched areas whereby the radiator ands repose in a notched area free of rail contact to fully expose the tabs on said ends and make them completely accessible for bending and rebending by any conventional tool.

19. Apparatus as defined in claim 12 including said rails being provided with a header sup orting surface in the form of an outwardly extending flange for engagement with the underside of the trough to provide a bearing point for a tab tool.

20. A fixturing apparatus for mounting a radiator tank to a radiator header for radiators including either brass tanks requiring soldering or plastic tanks secured by crimped integral header tabs against a gasket in a peripheral header trough, said apparatus comprising:

a pair of spaced vertically disposed support plates adapted to be removably secured to and suspended from any suitable overhead support, a depending arm assembly on each of said plates, each arm assembly including opposed individual arms forming a general bow configuration with respective top and bottom ends, the top ends of respective arms being in juxtaposition and individually pivotally secured to a respective plate so said bottom ends can be selectively moved towards and away from each other, said juxtaposed arm portions provided with registering arcuate slots, a threaded shaft on respective plates journalled through respective slots on each arm assembly, a manually operably knob on each respective shaft whereby said arms in respective arm assemblies can be tightened or loosened by a single respective knob, a pair of elongated opposed parallel rails pivotally secured to said bottom ends so they can be maintained parallel in any adjusted position of said arm assemblies, opposed parallel channel beams secured to and between said plates above and parallel to said rails, a hollow block housing provided with a plurality of spaced detent holes on one side and slidably disposed in said channel beams, a solid cylinder rotatably disposed in said housing, an elongated acme screw threadably journalled through said cylinder to define a top end with a handle and a bottom end defining a plunger head, a second housing depending from and rotatably mounted to the bottom of said screw, a pressure calibrated spring mounted within said second housing and engageable by said plunger head, visible pressure indicating indicia operably associated with said spring, a radiator tank engaging pad operably secured to the bottom end of said second housing, rotation of said cylinder effecting tilting of said screw and pad laterally away from a radiator tank to facilitate mounting a radiator on said rails, and detent means on said cylinder operably engageable with said detent holes to hold said screw and pad in any selected position of tilt.

21. Apparatus as defined in claim 20 including said channel beams provided with opposed notches near one end of insertion of said housing for slidable movement relative to said beams and to permit the addition and substraction of any selected number of said block housing.

22. Apparatus as defined in claim 20 including:

said radiator tank engaging pad being of inverted V-shape, the bottom of said second housing provided with a recess, and an integral stem projecting from the apex of said V operably engaged in said recess whereby said pad is rotatable with said second housing and tiltable in only two opposite directions relative to said recess.

23. Apparatus as defined in claim 20 including:

an overhead support ring defining a circular track, a pair of trollies movably mounted on said track, and means operably suspending said apparatus from said trollies.

24. Apparatus as defined in claim 20 including said rails having longitudinally spaced corresponding notched areas defining spaced planar radiator supporting surfaces intermediate said notched areas whereby the radiator ends repose in a notched area free of rail contact to fully expose the tabs on said ends and make them completely accessible for bending and rebending by any conventional tool.

25. Apparatus as defined in claim 20 including said rails being provided with a header supporting surface in the form of an outwardly extending flange for engagement with the underside of the trough to provide a bearing point for a tab tool.

* * * * *